United States Patent [19]

Putnam et al.

[11] Patent Number: 4,706,295

[45] Date of Patent: Nov. 10, 1987

[54] COAXIAL LOUDSPEAKER SYSTEM

[75] Inventors: Milton T. Putnam; William L. Putnam, both of Tarzana, Calif.

[73] Assignee: United Recording Electronic Industries, Hollywood, Calif.

[21] Appl. No.: 201,547

[22] Filed: Oct. 28, 1980

[51] Int. Cl.[4] ..... G10K 13/00

[52] U.S. Cl. ..... 381/156; 381/184

[58] Field of Search ..... 181/194, 184, 155, 185, 181/186, 144, 166, 192, 152; 179/115.5 H, 115.5 PS, 1 D, 116, 115.5 DV

[56] References Cited

U.S. PATENT DOCUMENTS

| | | | |
|---|---|---|---|
| 1,506,393 | 8/1924 | Thomas | 181/186 |
| 1,840,992 | 1/1932 | Weitling | 181/184 |
| 3,174,578 | 3/1965 | Kojima et al. | 181/27 |
| 4,171,734 | 10/1979 | Peveto et al. | 181/192 |
| 4,283,606 | 8/1981 | Buck | 179/115.5 H |

FOREIGN PATENT DOCUMENTS

| | | | |
|---|---|---|---|
| 600150 | 6/1934 | Fed. Rep. of Germany | 181/184 |

*Primary Examiner*—Robert Lev

*Attorney, Agent, or Firm*—Freilich, Hornbaker Rosen & Fernandez

[57] ABSTRACT

A coaxial loudspeaker system is described wherein the high frequency horn which lies within the lower frequency speaker or cone, is constructed to avoid the "shadow effect" wherein there is a large drop in the magnitude of the response of the low frequency speaker over a narrow frequency bandwidth due to diffraction effects caused by the presence of the horn. The horn is formed with a group of slots near its wide end, to provide an opening for the passage of lower frequency sounds into the axial region of the cone which would otherwise be blocked by the horn.

2 Claims, 6 Drawing Figures

COAXIAL LOUDSPEAKER SYSTEM

BACKGROUND OF THE INVENTION

Coaxial speaker systems utilize a low frequency speaker or cone coupled to a low frequency driver for propagating lower frequencies, and a higher frequency horn extending along the axis of the cone and driven by a separate high frequency driver to propagate higher frequency sounds. While such coaxial speaker systems are relatively compact, they have the disadvantage of displaying a "shadow effect". The shadow effect, caused by the presence of the horn along the center of the low frequency cone, results in a drop in low frequency speaker output near the axis of the horn, over a limited frequency bandwidth. Accordingly, there is considerable deviation from an ideal "flat" frequency-amplitude response of the cone over its useful frequency range. For example, in a coaxial system wherein the low frequency cone propagates sound of a frequency from about 20 Hz to about 2 kHz, and the horn propagates sound in a range from about 1.5 kHz to about 20 kHz, it is found that there is a serious drop in response of the system, as measured directly in front of the system, at a frequency close to about 1 kHz. A coaxial speaker system which avoided or minimized such a "shadow effect", would be of considerable value.

SUMMARY OF THE INVENTION

In accordance with one embodiment of the present invention, a coaxial loudspeaker system is provided, which minimizes the "shadow effect" wherein there is a loss of response of the lower frequency speaker or cone due to the presence of the higher frequency horn at the center of the cone. The horn is constructed so that it has slots, to provide openings for the passage of lower frequency sounds into the axial or center region of the cone which would otherwise be blocked. The slots can be formed near the large end of the horn, and the slots can be formed so they are elongated along the length direction of the horn, to provide a relatively clear opening for the passage of sound therethrough.

The novel features of the invention are set forth with particularity in the appended claims. The invention will be best understood from the following description when read in conjunction with the accompanying drawings.

DESCRIPTION OF THE PREFERRED EMBODIMENT

Figure 1:
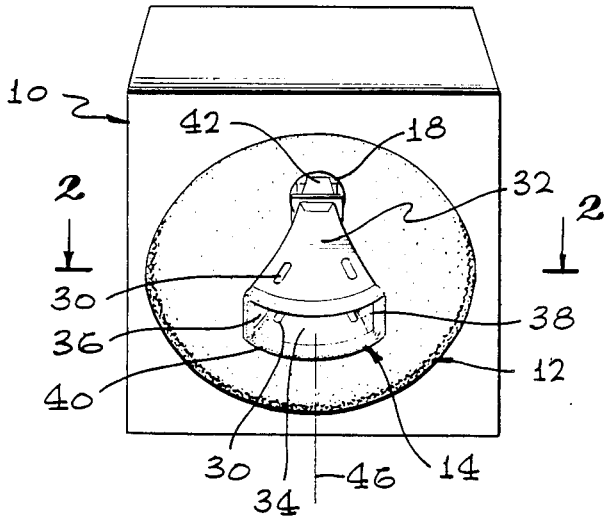
FIG. 1 is an isometric view of a coaxial speaker system constructed in accordance with the present invention.
Figure 2:
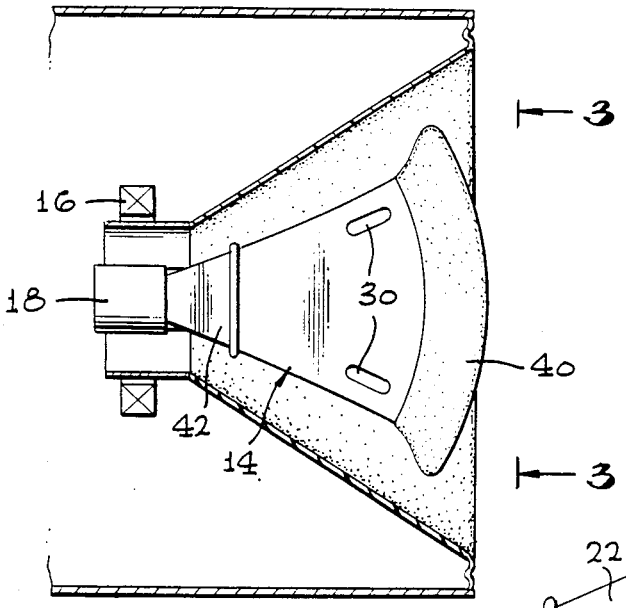
FIG. 2 is a partial sectional view taken on the line 2—2 of FIG. 1.

FIG. 1 illustrates a coaxial loudspeaker system 10 which includes a large loudspeaker 12 in the form of a cone for propagating lower frequency sounds such as those from about 20 Hz to about 2 kHz, and a higher frequency horn 14 for propagating higher frequency audible sounds such as those from 1.5 kHz to 20 kHz. In a duplex or coaxial system, the high frequency horn 14 is centered within the low frequency loudspeaker 12. The low frequency loudspeaker 12 is of cone shape so that it has a circular cross section perpendicular to the axis 46. The high frequency horn 14 has a greater horizontal width than its vertical height, to provide horizontal dispersion of higher frequency sounds to all areas of a wide room, the dispersicn by the horn being necessary because of the directionality of higher frequency sounds. The low frequency cone is driven by a voice coil or driver 16, while the high frequency horn is driven by a separate driver 18.

Figure 6:
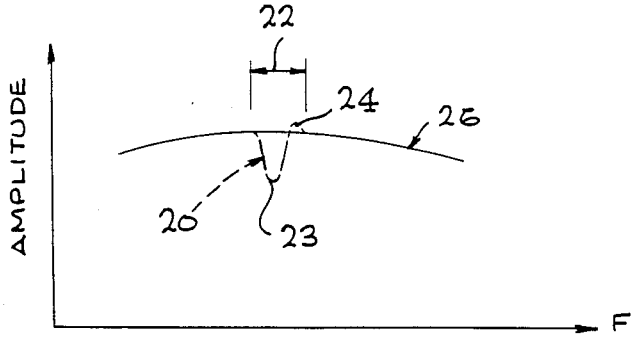
FIG. 6 is a graph showing the frequency-amplitude response of the cone portion of the speaker system of the present invention, and of the prior art.

While coaxial speaker systems have certain advantages, such as providing more compactness than separate speaker systems, prior art coaxial systems have had the serious disadvantage of displaying a "shadow effect". The shadow effect refers to the fact that the high frequency horn 14 blocks low frequency sounds in an axial region in front of the loudspeaker system. The non-directionality of low frequency sounds results in such blockage not being apparent, except that at certain frequencies the phase difference of sound waves diffracted around the high frequency horn can cause cancelling or reinforcement that seriously affects the performance of the speaker system. FIG. 6 illustrates a typical prior art response characteristic 20, showing that at a limited frequency band 22, the sound detected at a location in front of the speaker system decreases to a low level at 23 and increases to a relatively high level at 24, when electrical driving currents of constant amplitude but different frequencies are applied to the low frequency driver 16. Such variation in the output from the graph 26 representing the output in the absence of the high frequency speaker, constitutes a significant decrease in the response of the system.

Figure 3:
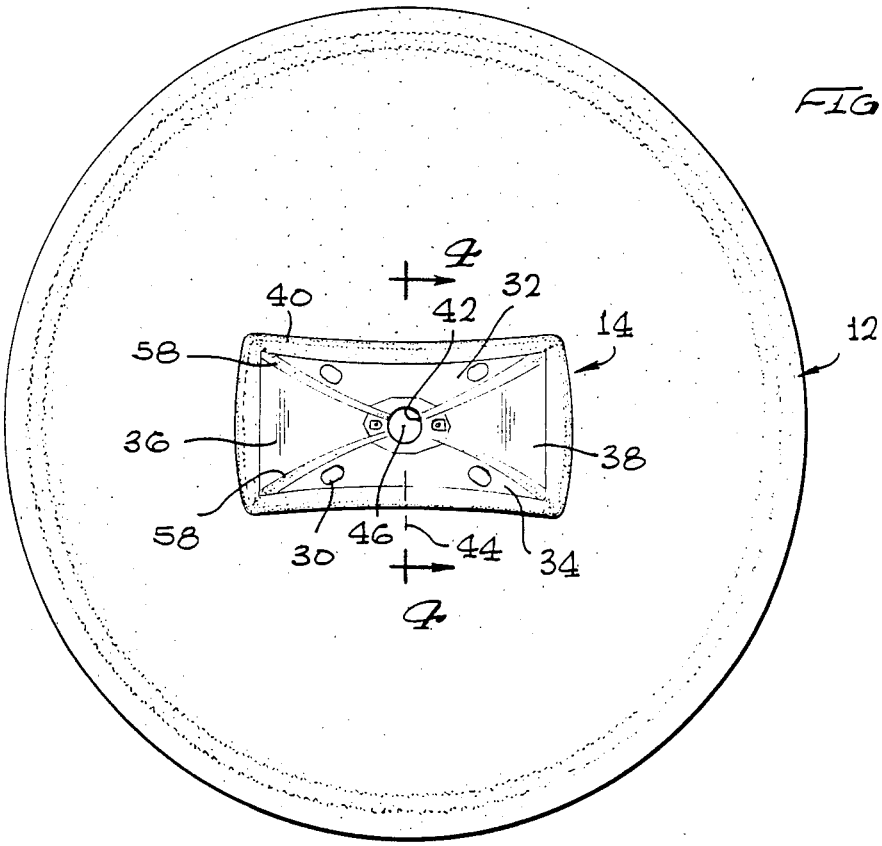
FIG. 3 is a view taken on the line 3—3 of FIG. 2.

In accordance with the present invention, the higher frequency horn 14 is constructed so it has a group of slot regions 30 that permit the passage of lower frequency sounds initially moving within the low frequency cone 12 but outside the horn 14, into the axial region of the cone which is enclosed by the horn 14. These low frequency sound waves then pass into the region lying directly in front of the horn 14, that might otherwise be blocked by the horn (to help fill in the missing sound above the graph point 23). The horn 14 (FIG. 3) has top and bottom main walls 32, 34 and opposite side walls 36, 38. The horn has a largely rectangular cross section, particularly near its large or mouth end 40, which couples to the atmosphere, sound that originally enters through the small or throat end 42 of the horn. The horn is of largely circular cross section at the throat end, but the cross section develops into a largely rectangular cross section, with a horizontal width much greater than its vertical height. The slot regions or slots 30 are formed in the main walls 32, 34 on opposite sides of an imaginary vertical plane 44 extending along the axis 46 of the horn.

Figure 5:
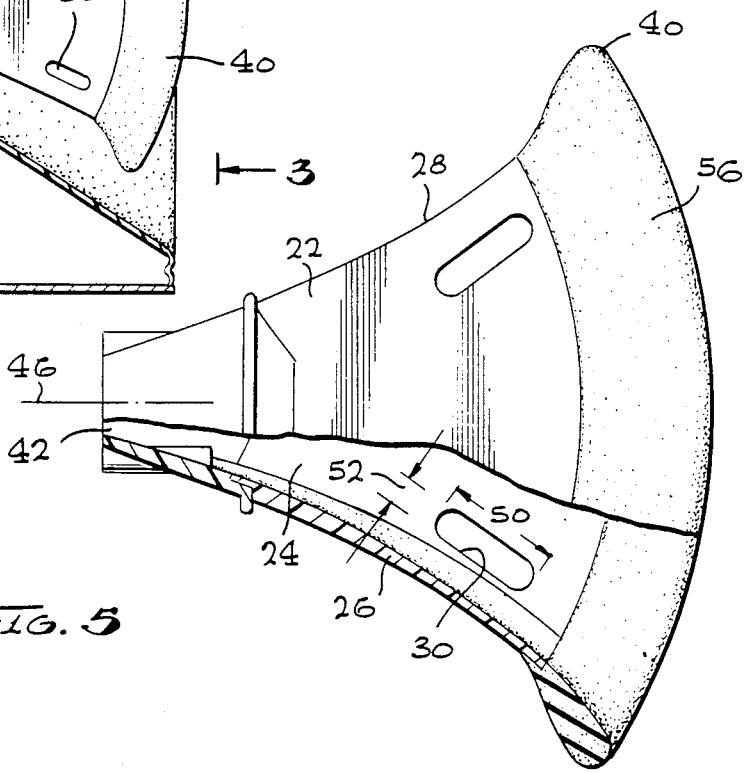
FIG. 5 is a view taken on the line 5—5 of FIG. 4.
Figure 4:
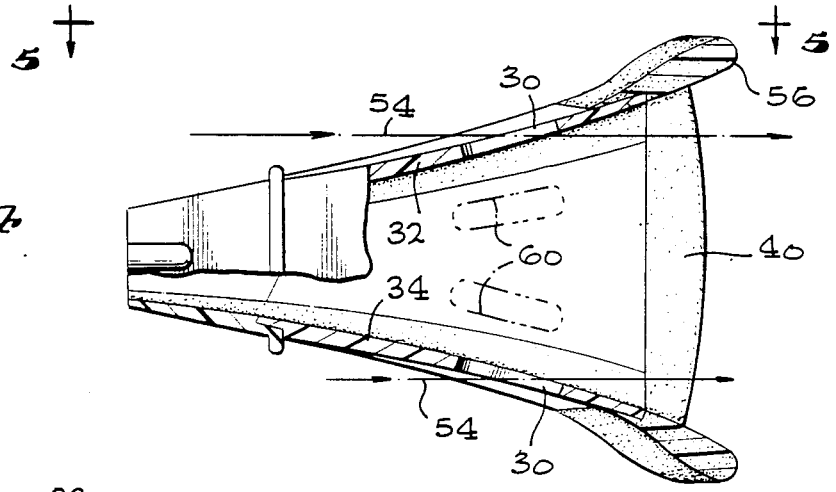
FIG. 4 is a view taken on the line 4—4 of FIG. 3.

Each of the slots 30 is elongated, with a length 50 (FIG. 5) which is much greater than its width 52, and with the length direction extending substantially parallel to the direction of sound propagation through the horn. Of course, sound at the center of the horn passes along the axis 46, while sound at either side of the horn tends to move in a direction to flare away from the axis 46. Because of the considerable flare of the horn, even vertically as shown in FIG. 4, the elongated slots 30 form openings which are of largely the same width as their height when viewed along the axis of the horn (as in FIG. 3.). This permits low frequency sounds travelling along the paths indicated at 54 (FIG. 4) to readily pass through the horn. The slots 30 extend from about the middle of the length of the horn to a location near the mouth end 40 of the horn. This is the region where the main walls 32, 34 of the horn extend at a considerable angle away from a horizontal plane, to facilitate the passage of low frequency sounds through the slots. The particular horn 14 is provided with a buffer 56 of material having a coefficient of sound absorption of about 50%, which is about halfway between the almost zero coefficient of most of the walls of the horn and the 100% coefficient of the atmosphere, to better couple sounds to the atmosphere. The slots 30 stop short of the buffer 56. The horn also has strips 58 of almost 100% sound absorption near the corners of the horn, and the slots lie immediately inside those strips. The use of elongated slots extending along the length direction of the horn, and lying near the mouth end of the horn, also minimizes the effect of the slots on the high frequency response of the horn. By locating the slots 30 closer to the mouth end of the horn, the slots of given width 52 occupy only a small percentage of the entire width of the horn thereat, as compared to the placement of slots of the same width near the throat end of the horn. High frequency sounds are largely directional, so that the amount of high frequency sounds that is interrupted in its smooth passage along the horn walls, is determined by the width of the slot, and to a much lesser extent by the length of the slot.

In one speaker system constructed in a manner illustrated in the drawings, the horn had a length, as measured along the axis 46 between its throat end 42 and its mouth end 40 of six inches and with the shape illustrated in the drawings. Various slot sizes and positions were tried. It was found that slots 30 of a length 50 of about 1½ inches, or about 4 centimeters, and a width 52 of ⅜ inch or about one centimeter, resulted in a relatively flat low frequency response as indicated by the graph 26 of FIG. 6, with negligible effect on the output of the high frequency horn. It is noted that the slots 30 should be located on either side of the vertical plane 44, inasmuch as positioning of the slots on the vertical plane would produce perturbations resulting in an uneven amplitude-frequency response of the high frequency horn when the output is measured in front of the horn near its axis.

It is possible to utilize slots in the side walls 36, 38 of the horn, such as by forming slots 60 in the side walls. It also may be noted that slots can be used in a horn of round cross-section near its mouth end, with such slots preferably located along the large end portion of the horn and elongated along the length direction of the horn.

Thus, the invention provides a high frequency horn for utilization in a coaxial loud speaker system, which minimizes the "shadow effect" that has characterized prior art coaxial systems. Such shadow effect, resulting in a significant drop in the loudspeaker output over a limited low frequency band, is avoided by the utilization of openings or slots in the walls of the higher frequency horn. Such slots are preferably elongated along the length direction of the horn, or along the direction of sound propagation through the high frequency horn, and are positioned along the larger end portion of the horn. For a horn of greater horizontal width than its height, the slots are preferably positioned on either side of an imaginary vertical plane passing through the axis of the horn, and preferably close to but spaced from either side wall of the horn. The slots can admit enough low frequency sound to avoid the "shadow effect", without significantly affecting the output of the high frequency horn.

Although particular embodiments of the invention have been described and illustrated herein, it is recognized that modifications and variations may readily occur to those skilled in the art and consequently it is intended that the claims be interpreted to cover such modifications and equivalents.

What is claimed is:

1. In a coaxial loudspeaker system which includes a large loudspeaker for propagating lower frequency sounds, and a small higher frequency horn lying largely within said large loudspeaker for propagating higher frequency sounds, the loudspeaker and horn each having small and large ends and an axis extending between them, and with said axes extending substantially coaxial and horizontal, and wherein said horn has a much greater horizontal width than its vertical height near its large end, the improvement wherein:

said higher frequency horn has a plurality of slots formed therein at locations between the small and large ends of the horn but closer to the large end of the horn, to admit lower frequency sounds initially moving within said large horn but outside said higher frequency horn, into a region bounded by said higher frequency horn;

each of said slots is elongate, has inner and outer end portions respectively closest to the small and to the large ends of the horn, and has a length as measured between said end portions which is at least about twice its width; and said slots lie at positions spaced from either side of an imaginary verticle center plane passing through the axis of said horn, but said horn is substantially devoid of slots on said vertical center plane.

2. In a coaxial loudspeaker system which includes a large loudspeaker with small and large ends for propagating lower frequency sounds, and a small higher frequency horn with small and large ends lying largely within said large loudspeaker for propagating higher frequency sounds, the small end of said horn being much smaller than the small end of said loudspeaker to leave a gap between them, the improvement wherein:

said higher frequency horn has a plurality of slots formed therein at locations between the small and large ends of the horn but closer to the large end of the horn, to admit lower frequency sounds initially moving within said large horn but outside said higher frequency horn, into a region bounded by said higher frequency horn;

each of said slots is elongated, has inner and outer end portions respectively closest to the small and to the large ends of the horn, and has a length as measured between said end portions which is at least about twice its width, and the inner end portion of each slot is substantially as wide as the outer end portion of the slot;

said horn and loudspeaker each have an axis extending between the centers of their small and large ends, said axes extend horizontally, and said horn has a horizontal width much greater than its verticle height near its large end; and said horn has upper and lower walls, said slots lie at positions spaced from either side of an imaginary vertical center plane passing through the axis of said horn, but the walls of said horn are substantially devoid of slots on said vertical center plane.

* * * * *